US006491558B1

(12) United States Patent
Myers

(10) Patent No.: US 6,491,558 B1
(45) Date of Patent: Dec. 10, 2002

(54) DUAL PONTOON FLOAT

(76) Inventor: Robert J. Myers, 2701 E. Hammer La., Suite 110, Stockton, CA (US) 95210

( * ) Notice: Subject to any disclaimer, the term of this patent is extended or adjusted under 35 U.S.C. 154(b) by 0 days.

(21) Appl. No.: 09/952,611

(22) Filed: Sep. 13, 2001

(51) Int. Cl.[7] ..... B62C 9/08
(52) U.S. Cl. ..... 441/130; 441/132
(58) Field of Search ..... 441/129, 130, 441/132, 40, 44, 45; 114/345, 61.1, 61.25; D21/803, 809

(56) References Cited

U.S. PATENT DOCUMENTS 3,769,647 A * 11/1973 Basa ..... 441/38
4,779,555 A * 10/1988 Hong ..... 114/345
5,171,178 A 12/1992 Creek et al.
5,290,196 A 3/1994 Steel
D374,264 S * 10/1996 Peterson ..... D21/803
5,711,240 A * 1/1998 Baker ..... 114/345
5,885,123 A * 3/1999 Clifford ..... 441/129
D430,845 S * 9/2000 Elsholz ..... D12/316
6,155,899 A * 12/2000 Boddy ..... 114/345
6,168,489 B1 1/2001 Huston
6,250,983 B1 * 6/2001 Paterson ..... 114/344
6,311,632 B1 * 11/2001 Noel, Jr. ..... 114/61.1

* cited by examiner

*Primary Examiner*—S. Joseph Morano
*Assistant Examiner*—Ajay Vasudeva
(74) *Attorney, Agent, or Firm*—Milburn & Peterson, P.C.; Robert C. Peterson

(57) ABSTRACT

A dual pontoon float having a pair of inflatable pontoons joined together by a rigid floatation seat which secures the pontoons in parallel and symmetrical alignment; an upper inflatable horseshoe body having arms is releasably secured to the pontoons by its arms in one of a more aft or more fore position relative to amidships for distributing the load; the arms are secured to the pontoons with loop and pile fasteners and belts and buckles; a backrest is attached to the center of the horseshoe body; the open end of the body includes a spacer or stabilizer bar, whereby the spacer bar and rigid floatation seat resist inward collapse and rotation of the pontoons; thus when inflated and assembled, provides a rigid, stable dual pontoon float with the pontoons parallel and symmetrical; storage compartments are attached to the arms and backrest; and an apron is releasably connected between the spacer bar and arms to provide a working surface.

16 Claims, 4 Drawing Sheets

DUAL PONTOON FLOAT

BACKGROUND OF THE INVENTION

1. Field

This invention relates to a float tube and more particularly a float tube with pontoons, which combines features of pontoon boats and float tubes. The float tubes and pontoons, being of material adapted to receiving inflatable bladders, which provide floatation thereto, upon inflation.

2. State of the Art

More recent float tubes come in various shapes, round, U-shaped, V-shaped or H-shaped. All but the round float tube have support bars to hold them open and keep them from spreading out and generally have a fabric seat sewn across the central opening. These various styles of float tubes sit low to the water and the user's body is mostly in the water. Several problems occur in these types of float tubes. In most, the bottom half of the body is in the water and hangs down through the tube. There is a tendency for the feet and legs to get tangled in the weeds, to drag on the bottom. They are not particularly comfortable and even with waders, the body get cold because the individual is submerged from the waist down.

Another major problem with the float tube and their designs is that they tend to compress or collapse when a person sits in them. These float tubes all have the same type of seat attachment, a "sling style" seat stitched across the bottom to the sides of the inflated tubes. The weight of the body on this seat tends to pull the sides inward causing discomfort. The bigger the person, the more the sides are pulled inward.

To prevent the sides from coming inward when weight is put on the seat, a stabilizer bar is sometimes used. This stabilizer bar is usually put in front of the tube to keep the sides from collapsing inward. The stabilizer bar helps prevent this but not entirely because the sides are inflated chambers and are not rigid, so they collapse inward around the stabilizer bar.

The single most detrimental or negative feature in float tubes on the market is that they tend to collapse inward on the person when sitting in them. The heavier the person, the more the sides are pulled inward. This effect causes discomfort and is very annoying. Again, the bigger the person, the more dramatic the effect and the more discomfort.

Other major problems with float tubes relate to safety because the body protrudes down through the tube and the seat is often attached to the stabilizer bar with a strap that goes between the user's legs. You are trapped in the tube should the tube lose air or should you tip over in the tube. Drownings have occurred because of this. Furthermore, other float tubes consist of one main chamber and one or two smaller chambers. Should you puncture the main chamber or get an air leak, you will more than likely go under and waders if used would quickly fill with water endangering the user.

Because of the shape of many float tubes, there is an adverse effect produced by wind and/or current. While fishing in a float tube or boat, it is important to remain facing in one direction. This allows individuals to effectively work their line. Most float tubes are difficult to keep facing one direction, as they tend to turn with the wind or current at will, causing difficulty for fishing, which is the intend use.

Various modifications to float tubes have been suggested, such as attaching them to pontoons, but problems have occurred. For example, U.S. Pat. No. 6,168,489 B, issued to Hutson, discloses a float tube with a pair of inflatable pontoons, with a general U-shaped support affixed to the pontoons with arms overlaying the pontoons, which joins a back support member. The back support member maintains proper spacing of the pontoons and the float tube is provided with a flexible seat between the two pontoons in front of the back support. Also a rigid separator is positioned between the two pontoons in from of the flexible seat. The float tube provides pouches secured to the arms and also may include a head rest on the back support.

Even with the separator and back support an individual seated on the flexible seat will have tendency to pull the pontoons inward and downward, especially with a relatively heavy individual.

SUMMARY OF THE INVENTION

Applicant has taken desirable features from a pontoon boat and a float tube and added certain features, which provide a unique watercraft or pontoon float.

The present invention provides a pair pontoons with a fabric seat secured between the inboard sides at the horizontal midline through the pontoons. The fabric being in the form of a pocket to house a rigid foam cushion having its sides shaped or cut at an acute angle, so that it is wider at the bottom than the top. The pocket holds the cushion partly below and partly above the midline through the pontoons.

The present invention includes a U-shaped inflatable upper unit positioned on top of a pair of inflatable pontoons, held spaced apart by a seat member and releasably attached to the pontoons with Velcro fasteners and belts with attached buckles. The Velcro fasteners have their loop members sewn to the underside of the U-shaped upper unit to mate with the pile section sewn to the upper portion of the pontoons. The Velcro fasteners are sufficiently wide to permit the upper unit to be positioned fore and aft to accommodate the user's posture. The open area of the upper unit accommodates a spacer or stabilizer bar to maintain the open area of the upper unit properly oriented, which in turn maintains the pontoons in the proper parallel orientation.

It is an object of the invention to provide a pontoon float having a pair of pontoons spaced apart by a rigid floatation seat wider a the bottom than at the top, which tends to push the pontoons outward at the bottom with a load on the seat. Each of the pontoons have sufficient Velcro fastener pile members sewn along the longitudinal axis of the pontoon, for mating with the loop members of the Velcro fasteners sewn to the bottom of the U-shaped upper unit, for securing the upper unit to the pontoon unit and further secured with straps and buckles, thus the upper unit maintains the pontoons in parallel alignment and firmly secured to the upper unit. A spacer bar is detachably secured to the arms of the U-shaped member to maintain the proper orientation of the upper unit arms.

It is another object of the inventions to provide a pontoon float having a lower unit composed a pair of pontoons spaced apart by a rigid seat member interposed between the pontoons and an upper U-shaped unit, which are inflatable and when inflated are attached to each other such that the pontoons of the lower unit are maintained parallel and the arms of the upper unit are maintained parallel by a spacer bar releasably secured there between. The rigid seat member is also a floatation device, which maintains the pontoons parallel with each other and resists inward collapse thereof. Each arm of the upper member includes a storage compartment secured to the upper unit. The rear of the upper unit has an inflatable back rest with a storage compartment affixed to the back rest. The spacer bar secures one end of a netting that fits over the lap of a user and is attached to the arms of the upper unit by a Velcro fastener at the rear of the net.

It is another object of the invention to provide a pontoon float, which may be carried in a back pack in a deflated and disassembled configuration that consists of a lower or pontoon section and an upper or U-shaped section having a backrest in which the lower pontoon section and the upper U-shaped section can be readily inflated, with the pontoons maintained separated by a rigid seat member with a wider bottom than top. The upper unit, when inflated, is secured to the lower float unit with Velcro fasteners and belts to maintain the lower section and the upper section rigid, stable and secured to each other. The upper unit has a complimentary spacer bar, which cooperates with the seat member to resist the pontoon float from closing inward on a user with the spacer bar and seat resisting rotation of the pontoons or arms.

It is a further object of the invention to provide a pontoon float having a pontoon section and upper horseshoe-shaped comfort section. The pontoon hull comprises a pair of inflatable pontoons spaced apart by a rigid seat member, and maintained parallel to each other by a horseshoe-shaped inflatable deck, designed to be connected to the inflatable hull to form a float tube. The deck can be positioned for comfort and load distribution, fore and aft form the center of the hull. The open end of the deck has a spacer bar, which compliments the seat member in maintaining the pontoons parallel and preventing inward collapse of the pontoons in conjunction with the beveled rigid seat member. The pontoons, as well as the deck, retain independent bladders for inflation.

It is an object of the inventions to provide a pontoon float having a pair of pontoons containing inflatable bladders spaced apart and maintained parallel by a rigid floatation member having a wider bottom than top, secured at the midline through the pontoons, with the member extending above and below the midline. A horseshoe-shaped body having a central backrest joining the arms of the body together removably mounted fore or aft from amidships for appropriately distributing the load. The rigid seat member together with a space bar, positioned between the arms, compliment each other in maintaining the pontoon float with its pontoons parallel and resists inward collapse of the pontoons, as well as, rotation of the pontoons. The upper body is secured to the pontoons by Velcro fasteners, belts and buckles. The body further includes a backrest containing an inflatable bladder, also flexible storage compartments.

If is a further object of the invention to provide a pontoon float consisting of a raft formed by port and starboard inflatable pontoons secured to each side of a beveled floatation member and an inflatable body releasably mountable in various fore or aft positions upon the raft having a central back spanning the pontoons and a pair of arms for retention to the port and starboard pontoons, respectively, with a spacer bar releasably extending between the pair of arms, whereby the port and starboard pontoons are maintained parallel and restrained from inward collapse by complimentary action of the spacer bar and beveled floatation member.

DETAILED DESCRIPTION OF THE PREFERRED EMBODIMENT

Figure 1:
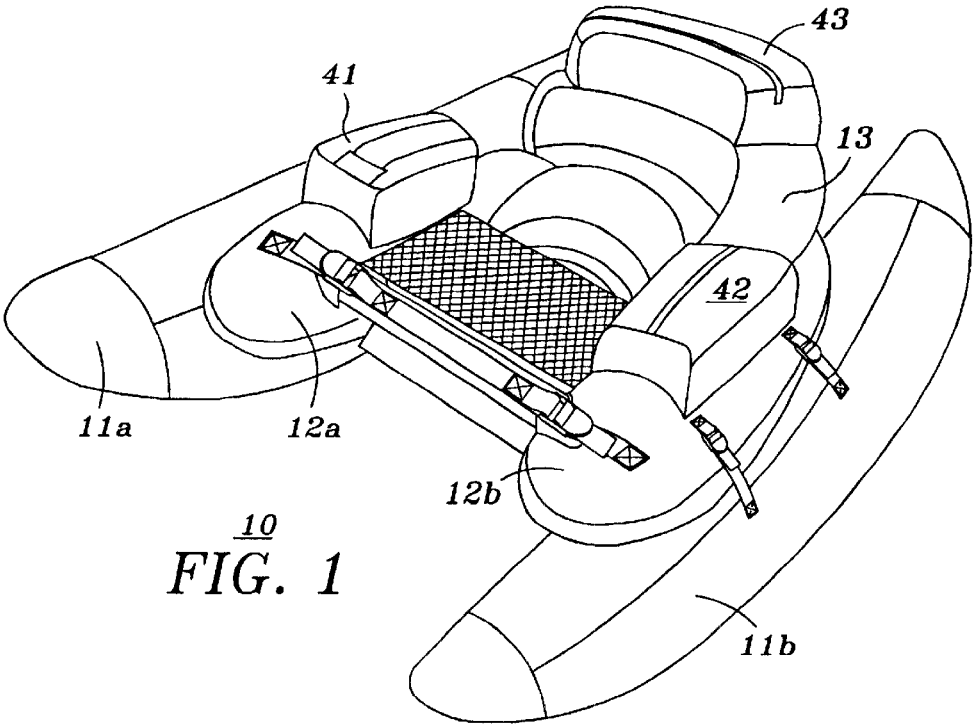
FIG. 1 is a perspective view of the assembled pontoon float.
Figure 6:
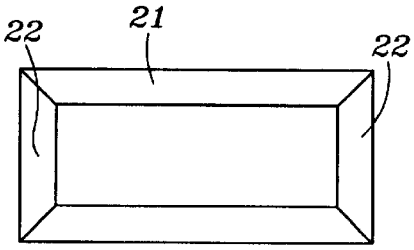
FIG. 6 is a top view of the rigid seat member.
Figure 7:
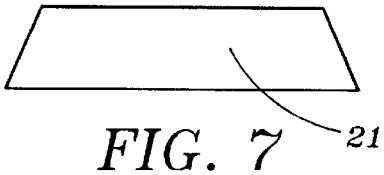
FIG. 7 is a front view of the rigid seat member.
Figure 8:
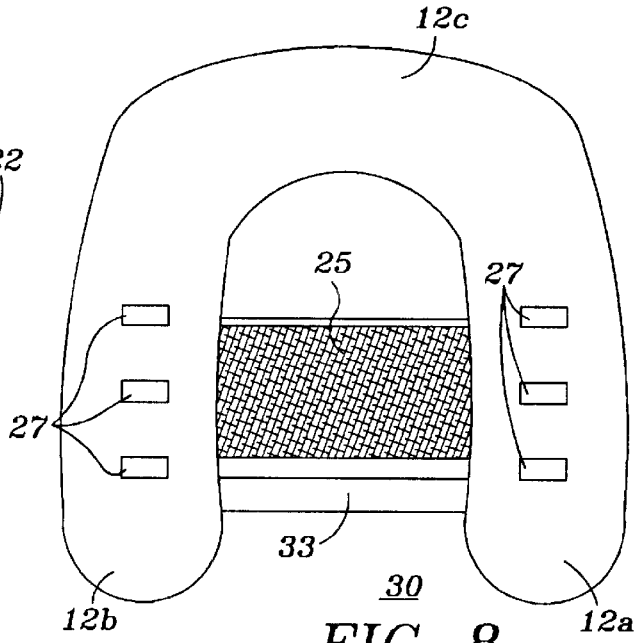
FIG. 8 is a bottom view of the body or housing.
Figure 2:
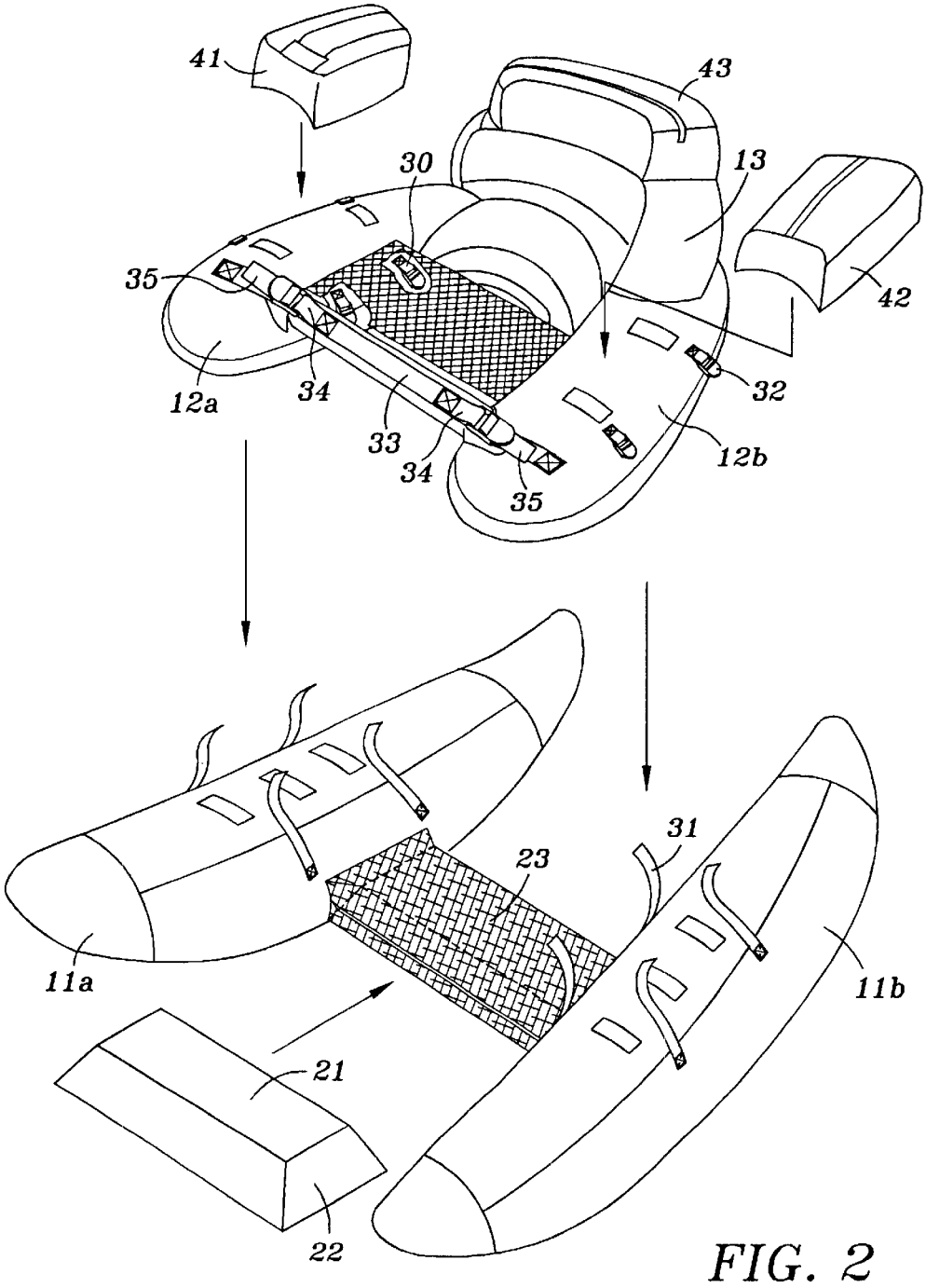
FIG. 2 is an exploded perspective view of the pontoon float.
Figure 3A:
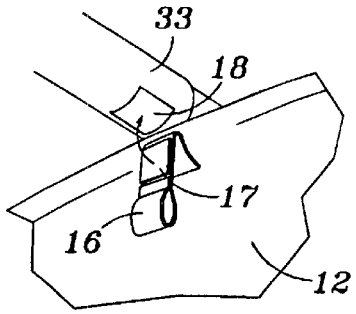
FIG. 3*a* is a partial perspective view of the loop and pile fastener for the stabilizer bar.
Figure 3:
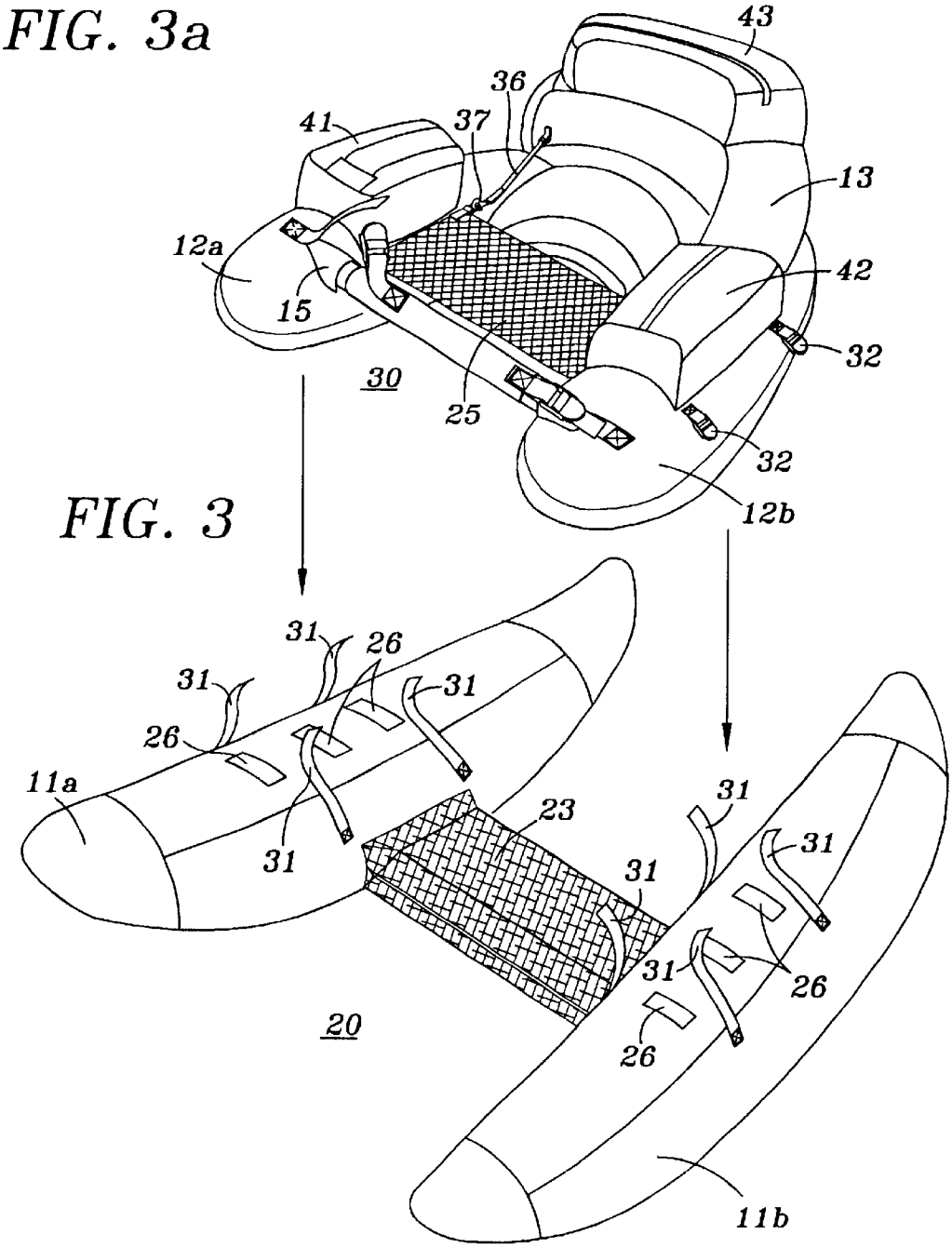
FIG. 3 is a perspective view of the inflated body and hull.
Figure 4:
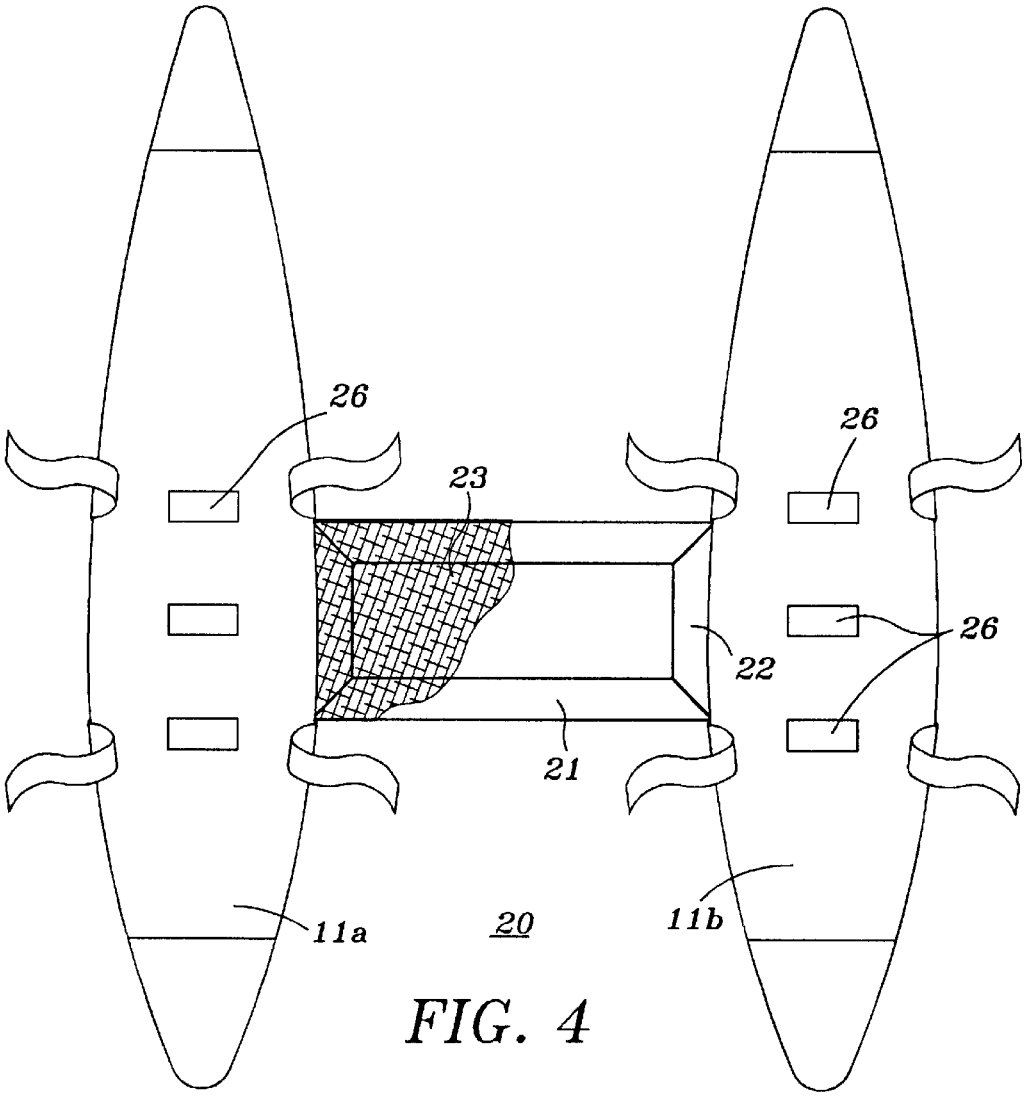
FIG. 4 is a top view of the hull or raft
Figure 5:
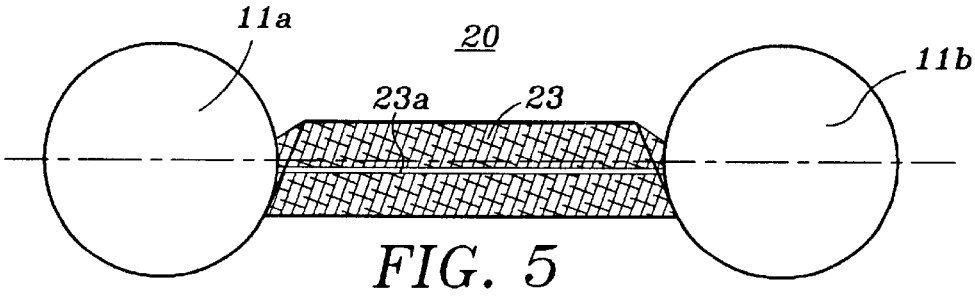
FIG. 5 is a front view of the hull or raft

Referring now to the drawings, FIG. 1 illustrates pontoon float 10 in its inflated and assembled condition. Pontoon float 10 has a raft or hull 20 and body or housing 30 (see FIG. 3). Raft section 20 includes a starboard pontoon 11*a* and a port pontoon 11*b*. Starboard pontoon 11*a* and port pontoon 11*b* are joined by seat member 23, which houses rigid foam seat 21, which has outwardly slanting or beveled sides 22 and is positioned within seat member 23 through opening 23*a*, which may include any suitable closure such as a zipper. Each pontoon 11*a* and 11*b* has sewn to it at least three relatively wide strips of Velcro pile in at least three locations on topside of pontoons 11*a* and 11*b*. Body or housing 30 as viewed FIG. 8 includes strips of Velcro loops 27 on the underside of starboard arm 12*a* and port arm 12*b*. Body 30 also includes a center back 12*c*, which joins starboard arm 12*a* and port arm 12*b*. Backrest 13 is sewn to center back 12*c*.

Internal bladders (not shown) in starboard pontoon 11*a* and port pontoon 12*b* are inflated and rigid foam seat 21 is inserted through opening 23*a* in seat member 23. Rigid foam seat 21 is positioned with its widest dimension slightly below the midline of starboard pontoon 11*a* and port pontoon 11*b*, thus when weight is put on seat member 23, the pontoons 11*a* and 11*b* remain spaced and do not collapse inward. Internal bladder (not shown) in body or housing 30 is inflated and body or housing 30 is positioned on top of raft or hull 20 with Velcro loops 27 meshed with the Velcro pile 26. Body 30 may positioned fore or aft as desired, thus providing adjustment of the load to be carried by the pontoon float 10. Housing 30 has buckles 32 inboard and outboard. The body 30 is secured by the Velcro fastener and then further secured by straps 31 threaded in buckles 32 and firmly secured. Spacer bar 33 has Velcro pile 18 secured to the underside of spacer bar 33 and strap 16 with Velcro loops 17 on starboard and port arms 12*a* and 12*b*, respectively, attached to the bottom side of spacer bar 33. Spacer bar 33 is seated in socket 15 on starboard arm 12*a* and port arm 12*b*. Spacer bar 33 has buckles 34 secured to the topside of spacer bar 33 and belts 35, sewn to starboard arm and port arm 12*a* and 12*b*, respectively, are coupled to buckles 34 and maintain starboard arm 12*a* and port arm 12*b* relatively fixed to each other with body or housing 30, positioned on raft or hull 20. Spacer bar 33 resists rotation of starboard pontoon 11*a* and port pontoon 11*b*, thus once assembled and inflated, pontoon float 10 is a rigid, stable structure. As a convenience, body 30 has mesh cloth or apron 25 attached to the spacer bar 33, which is fastened at the rear by a loop and pile fastener to arms 12*a* and 12*b*, and further may have a flexible cable 26 with a snap hook or other fastener 37 attaching the rear of the mesh cloth or apron 25 to backrest 13. In addition, body or housing 30 may have pouches or compartments 41 and 42 attached to starboard arm 12*a* and port arm 12*b*, respectively, which are of soft cloth and can be sewn directly to starboard arm 12*a* and port arm 12*b*. A third compartment 43 for storing convenience items is sewn on backrest 13. Compartment or headrest 43 has a bladder (not shown), which may be inflated to form a headrest and provide another floatation member.

In order to properly assemble pontoon float 10, the following procedure is preferable. First the deflated raft or hull 20 of pontoon float 10 and deflated body or housing 30 along with spacer bar 33 and rigid foam seat 21 are removed form the back pack carrier. Pontoons 11*a* and 11*b* of raft or hull 20 are inflated with sufficient pressure to become a rigid body, then rigid foam seat 21 is inserted in seat member 23 through opening 23*a* and is now ready for mounting of body or housing 30 on raft or hull 20 to complete the assembly of pontoon float 10. Body or housing 30 is inflated with sufficient air pressure to form rigid arms 12*a* and 12*b* and rigid center back 12*c*. Backrest 13 with its separate bladder (not shown) is also sufficiently inflated as part of rigid body or housing 30. Spacer bar 33 is inserted in sockets 15 of arms 12*a* and 12*b*. Straps 35 are connected to buckles 34 on spacer bar 33. Strap 16 is secured to spacer bar 33 by Velcro loop 17 and Velcro pile 18. Body or housing 30 is now ready to mount on raft or hull 20. Body or housing 30 is positioned over raft or hull 20, such that Velcro loop 27 meshed with Velcro pile 26 and maintain pontoons 11*a* and 11*b* parallel. Straps 31 are attached to buckles 32 to secure body or housing 30 firmly to raft or hull 20. Compartments 41 and 42, if provided separately, are then attached to arms 12*a* and 12*b* and headrest or compartment 43 is sewn to backrest 13. For ease of entry, the user may now unbuckle spacer bar 33 and release strap 16. Once seated on seat member 23, the user reconnects spacer bar 33 and may attach mesh cloth or apron 25 to the rear inside of arms 12*a* and 12*b* and connect flexible cable 36 to mesh cloth or apron 25. This arrangement provides a stable work surface or shelf.

Having described the preferred embodiment, it will be understood that Velcro pile 26 may be extended length wise of starboard pontoon 11*a* and port pontoon 11*b* to permit a more versatile mounting for body or housing 30 to raft or hull 20 to accommodate the load in a more fore or aft position from amidships. Compartments 41 and 42 may be mounted in any suitable manner and may be removably attached with loop and pile fasteners. It should be understood that starboard pontoon 11 a and port pontoon 11*b* have separate bladders for inflation purposes and the body or housing 30 has an opening at the rear to insert a bladder (not shown) in center back 12*c* and arms 12*a* and 12*b*, thus providing three separate air chambers for the pontoon float, as well as, seat member 23 being a floatation device. Also, backrest 13 and headrest 43 have bladders as additional air chambers. Consequently, if all bladders were punctured, seat member 23 would provide a floatation device to keep the individual afloat until he or she could reach safety in shallow water. Further, it should be understood with the seat member 23 attached at the midline between starboard pontoon 11*a* and port pontoon 11*b*, of raft or hull 20, the individual is mostly above the water, consequently drier.

What is claimed:

1. A pontoon float comprising:

a. two spaced-apart inflatable pontoons, each having a topside and a bottom, attached together at the inboard midlines of each pontoon by a seat member;

b. a U-shaped inflatable body having a pair of arms and a backrest, being releasably attached by its pair of arms to the topside of the pontoons;

c. a rigid floatation member having sides outwardly slanting from an upper side toward an underside, positioned within the seat member such that the upper side is above the midlines and the underside is below the midlines.

2. The pontoon float of claim 1 wherein the U-shaped inflatable body is attached to the topside of each spaced apart inflatable pontoon by loop and pile fasteners.

3. The pontoon float of claim 1 wherein the pair of arms are maintained in a spaced relation by a removable spacer bar.

4. The pontoon float of claim 1 wherein the inflatable body is attached to the topside of each inflatable pontoons by straps and buckles.

5. A pontoon float comprising:

a. two spaced-apart inflatable pontoons, each having a midline dividing the pontoons into an upper section and a lower section attached together at the midlines by a seat member having a top and a bottom wider than the top forming side wedges for maintaining the pontoons parallel and resisting inward collapse;

b. an inflatable upper body in the shape of a horseshoe, having an open end, releasably secured to the two spaced-apart pontoons by fasteners;

c. a stabilizer bar-releasably extending across the open end of the upper body;

d. wherein the seat member and the stabilizer bar compliment each other in maintaining the pontoons in stable, parallel alignment.

6. The pontoon float of claim 5 wherein the upper body and two spaced-apart pontoons are attached with loop and pile fasteners.

7. The pontoon float of claim 6 wherein the upper body is additionally secured to the spaced apart pontoons with straps and buckles.

8. The pontoon float of claim 5 wherein the upper body is attachable between a position more fore and more aft of amidships.

9. A pontoon float comprising:

a. a raft having a floatation member with wedged sides, centrally attached to a port pontoon and a starboard pontoon maintaining the port and starboard pontoons symmetrical and parallel;

b. an inflatable body having an aft member joining a port side and a starboard side with a fore opening, releasably attached to the port pontoon and the starboard pontoon by the port side and the starboard side, respectively, in one of a more aft and more fore position with respect to the raft;

c. a spacer bar releasably spanning the fore opening; and d. whereby the wedged sides compliment the spacer bar in resisting inward collapse and rotation of the port and starboard pontoons.

10. The pontoon float of claim 9 wherein the port side and the starboard side are releasably attached by loop and pile fasteners to the port pontoon and starboard pontoon, respectively.

11. The pontoon float of claim 10 wherein the starboard side and port side are releasably attached tot he starboard pontoon and the port pontoon, respectively, by straps and buckles.

12. The pontoon float of claim 11 herein the starboard side and port side have storage compartments attached thereto.

13. The pontoon float of claim,9 wherein an apron is attached tot he spacer bar and the starboard and port side to provide a work surface.

14. The pontoon float of claim 9 wherein a backrest is attached to the aft member of the inflatable body.

15. The pontoon float of claim 14 wherein a storage compartment is secured to the backrest.

16. The pontoon float of claim 14 wherein a headrest is secured to the backrest.

* * * * *